US007341160B2

(12) United States Patent
Cappel et al.

(10) Patent No.: US 7,341,160 B2
(45) Date of Patent: Mar. 11, 2008

(54) RECLOSABLE PACKAGE HAVING AN ACCESSIBLE ZIPPER AND A METHOD FOR MAKING THE SAME

(75) Inventors: Craig E. Cappel, Pittsford, NY (US); Gary E. Rehwinkel, Fairport, NY (US); Russell J. Talbo, Lyons, NY (US); Johann Natterer, Legau (DE)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/215,052

(22) Filed: Aug. 8, 2002

(65) Prior Publication Data

US 2004/0026423 A1 Feb. 12, 2004

(51) Int. Cl.

| | |
|---|---|
| ***B65D 45/00*** | (2006.01) |
| ***B65D 41/32*** | (2006.01) |
| ***B65D 73/00*** | (2006.01) |
| *B65D 33/14* | (2006.01) |
| *B65D 33/16* | (2006.01) |
| *B65D 65/26* | (2006.01) |

(52) U.S. Cl. ..... 220/315; 220/266; 206/461; 206/468; 206/469; 383/5; 383/61.2; 383/209; 383/210.1; 383/211

(58) Field of Classification Search ..... 220/315, 220/265, 266, 270, 359.1, 359.2, 359.4, 4.21; 206/461, 467, 468, 471; 383/5, 121, 121.1, 383/63, 64, 61.1–61.3, 210, 210.1, 211, 203, 383/204, 207–209, 9; 426/122, 123
See application file for complete search history.

(56) References Cited

U.S. PATENT DOCUMENTS

| | | | |
|---|---|---|---|
| 3,181,583 | A | 5/1965 | Lingenfelter |
| 3,381,592 | A | 5/1968 | Ravel |
| 3,473,589 | A | 10/1969 | Götz |
| 3,532,571 | A | 10/1970 | Ausnit |
| RE27,174 | E | 9/1971 | Ausnit |
| 3,608,439 | A | 9/1971 | Ausnit |
| 3,613,524 | A | 10/1971 | Behr et al. |
| 3,701,191 | A | 10/1972 | Laguerre |

(Continued)

FOREIGN PATENT DOCUMENTS

| | | | |
|---|---|---|---|
| EP | 0302144 | A2 * | 2/1989 |

(Continued)

*Primary Examiner*—Robin A. Hylton
(74) *Attorney, Agent, or Firm*—Baker Botts L.L.P.

(57) ABSTRACT

A reclosable package includes a tray, a top sheet, and a fastener. The tray has a well for receiving contents and a peripheral flange surrounding the well. The top sheet is attached to the peripheral flange. The fastener has two interlocking members, one attached to the peripheral flange and the other attached to the top sheet. A tamper-evident feature located on the package prevents access to the fastener and is connected thereto by one or two lines of weaknesses. In one embodiment with one or two lines of weakness in the top sheet, the fastener remains adjacent to the tray's peripheral flange, which is intact after the tamper-evident feature is removed by tearing along these lines of weakness. In a second embodiment with two lines of weakness, the tamper-evident feature, comprised of portions of the peripheral flange and the top sheet, is torn from the package along both lines of weakness.

26 Claims, 5 Drawing Sheets

U.S. PATENT DOCUMENTS

| | | | | |
|---|---|---|---|---|
| 3,701,192 | A | | 10/1972 | Laguerre |
| 3,785,111 | A | | 1/1974 | Pike |
| 3,839,128 | A | | 10/1974 | Arai |
| 3,948,705 | A | | 4/1976 | Ausnit |
| 4,094,729 | A | | 6/1978 | Boccia |
| 4,196,030 | A | | 4/1980 | Ausnit |
| 4,240,241 | A | | 12/1980 | Sanborn, Jr. |
| 4,241,865 | A | | 12/1980 | Ferrell |
| 4,246,288 | A | | 1/1981 | Sanborn, Jr. |
| 4,277,241 | A | | 7/1981 | Schulze |
| 4,341,575 | A | | 7/1982 | Herz |
| 4,355,494 | A | | 10/1982 | Tilman |
| 4,372,793 | A | | 2/1983 | Herz |
| 4,415,386 | A | | 11/1983 | Ferrell et al. |
| 4,430,070 | A | | 2/1984 | Ausnit |
| 4,437,293 | A | | 3/1984 | Sanborn, Jr. |
| 4,517,788 | A | | 5/1985 | Scheffers |
| 4,528,224 | A | | 7/1985 | Ausnit |
| 4,563,319 | A | | 1/1986 | Ausnit et al. |
| 4,581,006 | A | | 4/1986 | Hugues et al. |
| 4,582,549 | A | | 4/1986 | Ferrell |
| 4,589,145 | A | | 5/1986 | Van Erden et al. |
| 4,601,694 | A | | 7/1986 | Ausnit |
| 4,617,683 | A | | 10/1986 | Christoff |
| 4,620,320 | A | | 10/1986 | Sullivan |
| 4,651,504 | A | | 3/1987 | Bentsen |
| 4,655,862 | A | | 4/1987 | Christoff et al. |
| 4,663,915 | A | | 5/1987 | Van Erden et al. |
| 4,666,536 | A | | 5/1987 | Van Erden et al. |
| 4,673,383 | A | | 6/1987 | Bentsen |
| 4,691,372 | A | | 9/1987 | Van Erden |
| 4,703,518 | A | | 10/1987 | Ausnit |
| 4,709,398 | A | | 11/1987 | Ausnit |
| 4,709,533 | A | | 12/1987 | Ausnit |
| 4,710,157 | A | | 12/1987 | Posey |
| 4,782,951 | A | | 11/1988 | Griesbach et al. |
| 4,787,880 | A | | 11/1988 | Ausnit |
| 4,790,126 | A | | 12/1988 | Boeckmann |
| 4,807,300 | A | | 2/1989 | Ausnit et al. |
| 4,812,074 | A | | 3/1989 | Ausnit et al. |
| 4,823,961 | A | | 4/1989 | Griesbach et al. |
| 4,840,012 | A | | 6/1989 | Boeckmann |
| 4,840,611 | A | | 6/1989 | Van Erden et al. |
| 4,844,759 | A | | 7/1989 | Boeckmann |
| 4,850,178 | A | | 7/1989 | Ausnit |
| 4,876,842 | A | | 10/1989 | Ausnit |
| 4,878,987 | A | | 11/1989 | Ven Erden |
| 4,892,414 | A | | 1/1990 | Ausnit |
| 4,892,512 | A | | 1/1990 | Branson |
| 4,894,975 | A | | 1/1990 | Ausnit |
| 4,896,775 | A | | 1/1990 | Boeckmann et al. |
| 4,909,017 | A | | 3/1990 | McMahon et al. |
| 4,924,655 | A | | 5/1990 | Posey |
| 4,925,318 | A | | 5/1990 | Sorensen |
| 4,929,225 | A | | 5/1990 | Ausnit et al. |
| 4,941,307 | A | | 7/1990 | Wojcik |
| 4,949,527 | A | | 8/1990 | Boeckmann et al. |
| 4,969,309 | A | | 11/1990 | Schwarz et al. |
| 4,974,395 | A | | 12/1990 | McMahon |
| 4,993,212 | A | | 2/1991 | Veoukas |
| 5,005,707 | A | | 4/1991 | Hustad et al. |
| 5,014,498 | A | | 5/1991 | McMahon |
| 5,014,856 | A | | 5/1991 | Griesbach et al. |
| 5,027,584 | A | | 7/1991 | McMahon et al. |
| 5,036,643 | A | | 8/1991 | Bodolay |
| 5,036,645 | A | * | 8/1991 | Schwarz ..... 53/412 |
| 5,042,224 | A | | 8/1991 | McMahon |
| 5,046,300 | A | | 9/1991 | Custer et al. |
| 5,047,002 | A | | 9/1991 | Zieke et al. |
| 5,050,736 | A | | 9/1991 | Griesbach et al. |
| 5,063,639 | A | | 11/1991 | Boeckmann et al. |
| 5,067,208 | A | | 11/1991 | Herrington, Jr. et al. |
| 5,072,571 | A | | 12/1991 | Boeckmann |
| 5,077,064 | A | * | 12/1991 | Hustad et al. ..... 426/106 |
| 5,085,031 | A | | 2/1992 | McDonald |
| 5,088,971 | A | | 2/1992 | Herrington |
| 5,092,831 | A | | 3/1992 | James et al. |
| 5,096,516 | A | | 3/1992 | McDonald et al. |
| 5,105,603 | A | | 4/1992 | Natterer |
| 5,107,658 | A | | 4/1992 | Hustad et al. |
| 5,111,643 | A | | 5/1992 | Hobock |
| 5,116,301 | A | | 5/1992 | Robinson et al. |
| 5,127,208 | A | | 7/1992 | Custer et al. |
| 5,131,121 | A | | 7/1992 | Herrington, Jr. et al. |
| 5,147,272 | A | | 9/1992 | Richison et al. |
| 5,161,286 | A | | 11/1992 | Herrington, Jr. et al. |
| 5,179,816 | A | | 1/1993 | Wojnicki |
| 5,188,461 | A | | 2/1993 | Sorensen |
| 5,198,055 | A | * | 3/1993 | Wirth et al. ..... 156/66 |
| 5,211,482 | A | | 5/1993 | Tilman |
| 5,224,779 | A | * | 7/1993 | Thompson et al. ..... 383/5 |
| 5,247,781 | A | | 9/1993 | Runge |
| 5,254,073 | A | | 10/1993 | Richison et al. |
| 5,259,904 | A | | 11/1993 | Ausnit |
| 5,273,511 | A | | 12/1993 | Boeckman |
| 5,322,579 | A | | 6/1994 | Van Erden |
| 5,334,127 | A | | 8/1994 | Bruno et al. |
| 5,383,989 | A | | 1/1995 | McMahon |
| 5,400,565 | A | | 3/1995 | Terminella et al. |
| 5,400,568 | A | | 3/1995 | Kanemitsu et al. |
| 5,405,478 | A | | 4/1995 | Richardson et al. |
| 5,405,629 | A | | 4/1995 | Marnocha et al. |
| 5,412,924 | A | | 5/1995 | Ausnit |
| 5,415,904 | A | | 5/1995 | Takubo et al. |
| 5,425,216 | A | | 6/1995 | Ausnit |
| 5,425,825 | A | | 6/1995 | Rasko et al. |
| 5,431,760 | A | | 7/1995 | Donovan |
| 5,435,864 | A | | 7/1995 | Machacek et al. |
| 5,442,837 | A | | 8/1995 | Morgan |
| 5,448,807 | A | | 9/1995 | Herrington, Jr. |
| 5,470,156 | A | | 11/1995 | May |
| 5,482,375 | A | | 1/1996 | Richardson et al. |
| 5,489,252 | A | | 2/1996 | May |
| 5,492,411 | A | | 2/1996 | May |
| 5,505,037 | A | | 4/1996 | Terminella et al. |
| 5,509,735 | A | | 4/1996 | May |
| 5,511,884 | A | | 4/1996 | Bruno et al. |
| 5,519,982 | A | | 5/1996 | Herber et al. |
| 5,525,363 | A | | 6/1996 | Herber et al. |
| 5,542,902 | A | | 8/1996 | Richison et al. |
| 5,551,127 | A | | 9/1996 | May |
| 5,551,208 | A | | 9/1996 | Van Erden |
| 5,557,907 | A | | 9/1996 | Malin et al. |
| 5,558,613 | A | | 9/1996 | Tilman et al. |
| 5,561,966 | A | | 10/1996 | English |
| 5,564,259 | A | | 10/1996 | Stolmeier |
| 5,573,614 | A | | 11/1996 | Tilman et al. |
| 5,582,853 | A | * | 12/1996 | Marnocha et al. ..... 426/122 |
| 5,592,802 | A | | 1/1997 | Malin et al. |
| 5,603,202 | A | | 2/1997 | Hanagata |
| 5,613,934 | A | | 3/1997 | May |
| 5,628,566 | A | | 5/1997 | Schreiter |
| 5,647,671 | A | | 7/1997 | May |
| 5,651,462 | A | * | 7/1997 | Simonsen et al. ..... 206/557 |
| 5,669,715 | A | | 9/1997 | Dobreski et al. |
| 5,672,234 | A | | 9/1997 | Rodenstein et al. |
| 5,682,730 | A | | 11/1997 | Dobreski |
| 5,706,635 | A | | 1/1998 | Simmons |
| 5,722,128 | A | | 3/1998 | Toney et al. |
| 5,725,312 | A | | 3/1998 | May |
| 5,782,733 | A | | 7/1998 | Yeager |
| 5,788,378 | A | | 8/1998 | Thomas |
| 5,823,933 | A | | 10/1998 | Yeager |
| 5,833,791 | A | | 11/1998 | Bryniarski et al. |

5,906,438 A 5/1999 Laudenberg
5,924,173 A 7/1999 Dobreski et al.
5,956,924 A 9/1999 Thieman
5,964,532 A * 10/1999 St. Phillips et al. ..... 383/5
6,044,621 A 4/2000 Malin et al.
6,131,248 A * 10/2000 Tomic ..... 24/304
6,131,369 A * 10/2000 Ausnit ..... 53/412
6,138,436 A 10/2000 Malin et al.
6,138,439 A 10/2000 McMahon et al.
6,161,271 A 12/2000 Schreiter
6,212,857 B1 4/2001 Van Erden
6,216,423 B1 4/2001 Thieman
6,273,607 B1 8/2001 Buchman
6,279,298 B1 8/2001 Thomas et al.
6,286,189 B1 9/2001 Provan et al.
6,286,999 B1 9/2001 Cappel et al.
6,289,561 B1 9/2001 Provan et al.
6,290,390 B1 9/2001 Buchman
6,292,986 B1 9/2001 Provan et al.
6,293,896 B1 9/2001 Buchman
6,327,754 B1 12/2001 Belmont et al.
6,327,837 B1 * 12/2001 Van Erden ..... 53/412
6,347,437 B2 2/2002 Provan et al.
6,347,885 B1 2/2002 Buchman
6,360,513 B1 3/2002 Strand et al.
6,363,692 B2 4/2002 Thieman
6,412,254 B1 7/2002 Tilman et al.
6,419,391 B2 7/2002 Thomas
6,427,421 B1 8/2002 Belmont et al.
6,880,973 B2 * 4/2005 Schneider et al. ..... 383/204
2001/0005973 A1 7/2001 Schneider et al.
2001/0045083 A1 11/2001 McMahon et al.
2003/0202717 A1 * 10/2003 Schneider et al. ..... 383/5
2003/0202720 A1 * 10/2003 VandenHeuvel et al. .... 383/204
2003/0219173 A1 * 11/2003 Schneider ..... 383/9
2004/0179753 A1 * 9/2004 Schneider et al. ..... 383/5

FOREIGN PATENT DOCUMENTS

EP 1 026 077 A2 8/2000
WO WO 01/53158 A2 7/2001
WO WO 01/53158 A3 7/2001
WO WO 02/12064 A1 2/2002
WO WO 02/13649 A1 2/2002

* cited by examiner

Fig. 6A
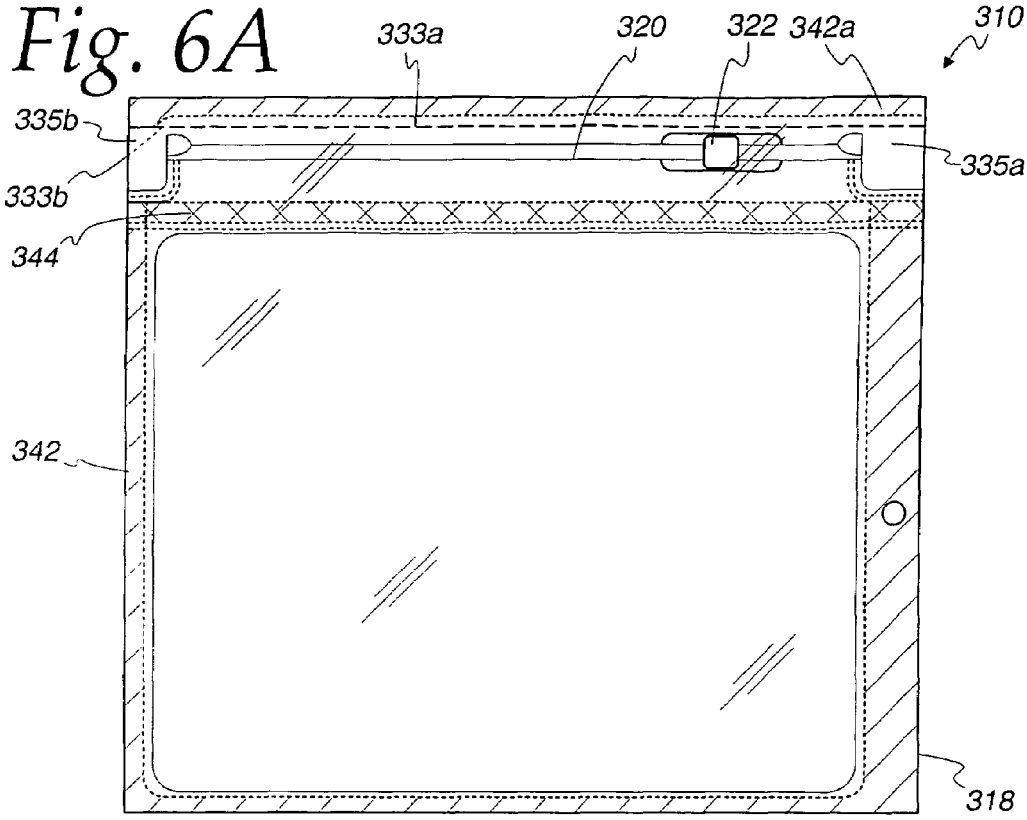
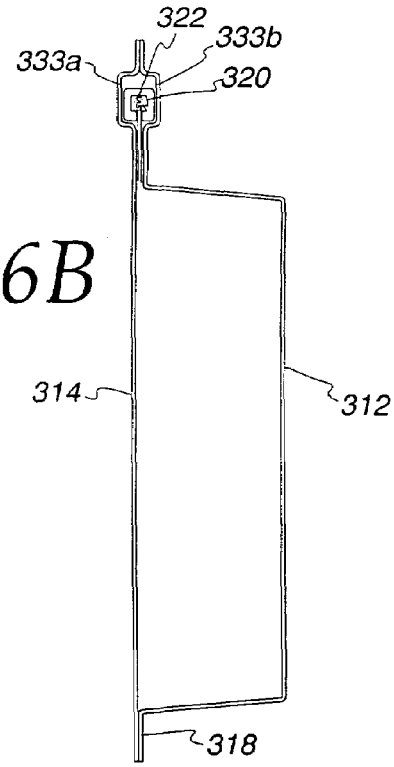
Fig. 6B
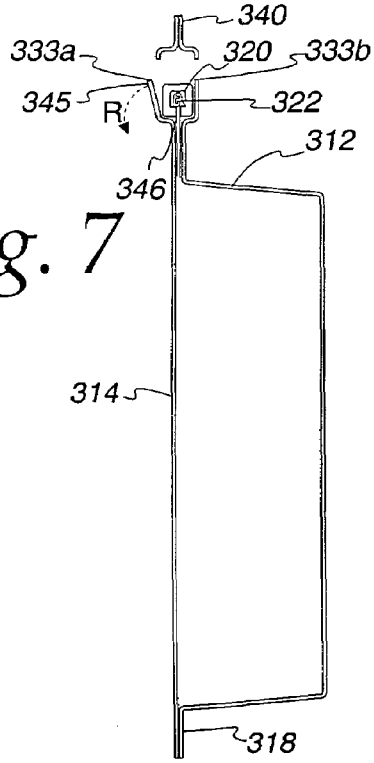
Fig. 7

RECLOSABLE PACKAGE HAVING AN ACCESSIBLE ZIPPER AND A METHOD FOR MAKING THE SAME

FIELD OF THE INVENTION

The present invention relates to reclosable packages and, in particular, to packages that have a formed tray with a flexible cover over the tray.

BACKGROUND OF THE INVENTION

Plastic packages are popular for storing food products and other items. Reclosable packages that can be securely closed and reopened are particularly popular due to their ability to maintain freshness of the food stored in the package and to minimize leakage to and from the package. Thus, reclosable packages are very common, especially in the food industry.

Reclosable packages are typically made to be reclosable via the use of a reclosable feature, such as a resealable adhesive seal or a reclosable zipper. Reclosable zippers can be opened and closed either by finger pressure or by use of an auxiliary slider mechanism. Because of the mechanical sealing provided by a zipper, the zipper has become the preferred type of reclosable feature.

In one particular type of package, a formed tray is sealed by flexible cover that is positioned over the formed tray. These formed-tray packages are especially useful for packaging items such as meats and cheese. Because these types of contents are not all used at once, it is desirable to have these formed-tray packages include a tamper-evident feature and a reclosable zipper. Further, because the opening and closing of these zippers is more easily accomplished by use of a slider, consumers prefer a slider-actuated zipper.

The present invention relates to an improved formed-tray package having a tamper-evident feature and a zipper that is preferably actuated by a slider.

SUMMARY OF THE INVENTION

The present invention is a reclosable package having a tray, a top sheet, and a fastener. The tray has a well and a peripheral flange. The well receives contents and the peripheral flange surrounds the well. The top sheet is attached to the peripheral flange.

The fastener has first and second interlocking members. The first interlocking member is attached to the peripheral flange and the second interlocking member is attached to the top sheet. A tamper-evident feature is attached to the top sheet along a line of weakness and prevents access to the fastener. The tamper-evident feature is also removably attached to the peripheral flange, usually by a peel seal.

To gain initial access to the package, the tamper-evident feature is removed from the package to allow access to the fastener. After the tamper-evident feature is removed from the package by tearing it from the top sheet along the line of weakness, the peripheral flange of the tray remains entirely intact. As such, in this first embodiment, the removable tamper-evident feature is a part of only the top sheet.

In a variation of this first embodiment, the tamper-evident feature may be attached to the peripheral flange with a stronger seal. The top sheet, however, includes a second line of weakness near the stronger seal, allowing the tamper-evident feature to be torn from the package between the two lines of weakness. Thus, the tamper-evident feature is that portion of the top sheet defined between the two lines of weakness.

In a second embodiment, the top sheet is attached to the sides and the bottom of the peripheral flange with a generally continuous first seal. The top sheet is further attached to the top of the peripheral flange with a generally continuous second seal. The first seal is spaced away from the second seal. The fastener has a first interlocking member attached to the peripheral flange and a second interlocking member attached to the top sheet. The fastener provides a seal between the top sheet and the tray along a line that extends between the two sides of the peripheral flange.

In this second embodiment, a tamper-evident feature is attached to the top sheet along a first line of weakness and attached to the peripheral flange of the tray along a second line of weakness. The first and second lines of weakness are above the first seal. The tamper-evident feature is removable from the package along the lines of weakness to allow access to the fastener.

The above summary of the present invention is not intended to represent each embodiment, or every aspect, of the present invention. This is the purpose of the Figures and the detailed description which follow.

BRIEF DESCRIPTION OF THE DRAWINGS

The foregoing and other advantages of the invention will become apparent upon reading the following detailed description and upon reference to the drawings.

FIGS. 6A and 6B illustrate a package according to another embodiment of the present invention.

FIG. 7 illustrates the package of FIG. 6 after a removable section of the top cover has been removed to provide access to the fastener.

Figure 1A:
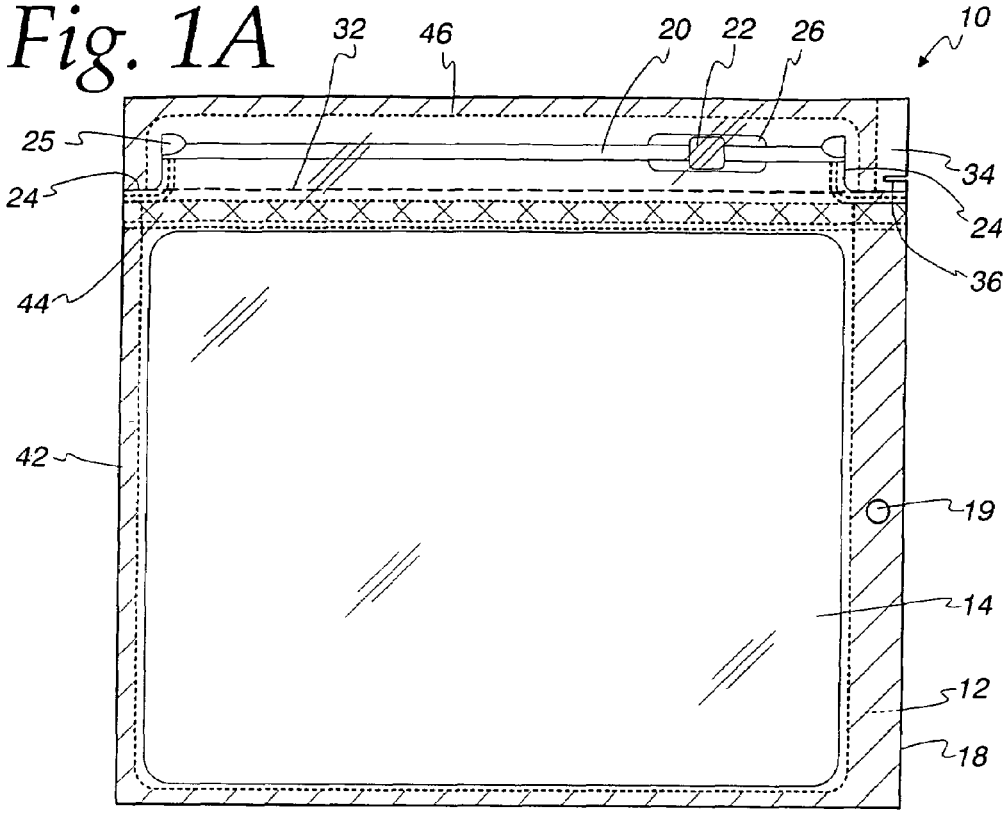
FIGS. 1A and 1B illustrate a package according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1B:
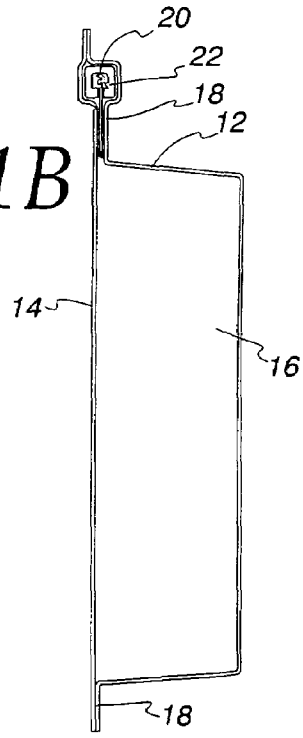

FIGS. 1A and 1B illustrate a package 10 having a tray 12 and the top sheet 14 (or "top cover"). The tray 12 has a well 16 in which contents can be placed and a peripheral flange 18 extending around the well 16. The package may include a peg hole 19 for receiving a peg from which the package 10 may hang in a retail store.

To gain access to the contents located within the well 16, a fastener 20 is located along the top portion of the peripheral flange 18. As is known in the art, the fastener 20 includes first and second interlocking members that can be manipulated to open and close the package 10. The fastener 20 also includes fins extending downwardly from the interlocking members. In this package 10, one fin is attached to the top sheet 14 while the other fin is attached to the tray 12. Preferably, the fastener 20 includes a slider 22 that allows the user to more easily open and close the interlocking members of the fastener 20. The fastener 20 also includes a sealed notch region 24 located at the two terminal ends of the interlocking members. These sealed notches 24 are useful in the process used to manufacture and assemble the fastener 20 by itself before it is placed on the package 10. The fastener 20 and its notches 24 are disclosed in more detail in U.S. patent application Ser. No. 09/636,421, which is incorporated herein by reference in its entirety. The fastener 20 also includes end terminations 25 for limiting the movement of the slider 22. The end termination 25 can be made by over-molding material on the end termination or by ultrasonic crushing.

The tray 12 preferably includes a slider recess 26 in which the slider 22 resides so that the slider 22 does not hinder the sealing process that is used to attach the top sheet 14 to the peripheral flange 18. This slider recess 26 is preferably located at a region on the top portion of the peripheral flange 18 such that the slider 22 is parked in its closed position or adjacent to its closed position. The reason that it may be preferable to locate the slider recess 26 at a point where the slider 22 is not fully closed relates to the fact that it is often desirable to evacuate the package 10 during its assembly, and it is necessary to have an opening in the interlocking members of the fastener 20 through which air located within the fastener 20 between the interlocking members and a sealed portion of the fins below the interlocking members can vacate the fastener 20. This will be discussed below in more detail.

Figure 2:
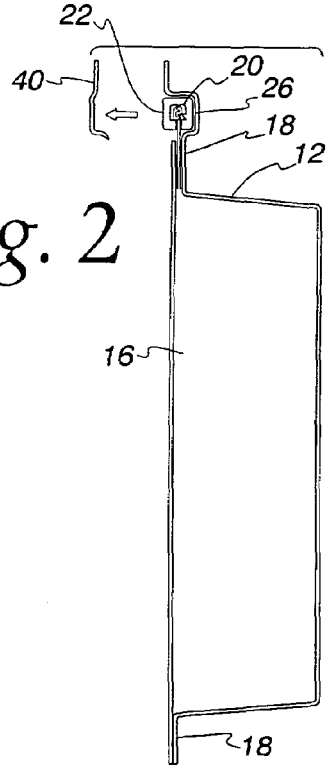
FIG. 2 illustrates the package of FIG. 1 after a removable section of the top cover has been removed to provide access to the fastener.

The top sheet 14 has a line of weakness 32 adjacent to the fastener 20 and preferably located between an uppermost portion of the slider 22 and the well 16. The line of weakness 32 may be in several forms, such as mechanical scores, laser scores, perforations, or thinned sections. The top sheet 14 also includes a graspable section 34 that includes a tear line 36. When the consumer initially desires to gain access to the contents of the package 10, the consumer grasps the graspable section 34 and begins tearing the top sheet 14 above the tear line 36. Thus, the top sheet 14 can be thought of as being attached to or including a removable section 40 as is shown in FIG. 2. This removable section 40 provides a tamper-evident feature to the package 10. The top part of the flange 18 remains intact after the initial accessing to allow the consumer to grasp the package when moving the slider 22 to open the package 10.

To better preserve the contents in the package 10, the package 10 includes a hermetic seal 42 between the tray 12 and the top sheet 14 along the left side, right side, and bottom of the flange 18. Further, the fastener 20 includes a hermetic seal 44, usually brought about through the attachment of fins extending downwardly from the interlocking members. This seal 44 on the fastener 20 is preferably a tamper-evident, barrier seal, such as the one described in U.S. patent application Ser. No. 09/468,165, which is owned by the assignee of the present application and is incorporated herein by reference in its entirety. Because the interlocking members of the fastener 20 are located outside the hermetic seal 44 provided by the fin structure of the fastener 20, there is less chance for the interlocking members to cause side seal leaks as they are outside the region that must be flattened to develop the hermetic seals 42. A top seal 46, usually a peelable seal, between the flange 18 and the top sheet 14 partially surrounds the fastener 20.

The hermetic seal 42 on the left side, right side, and bottom of the flange 18 is strong and is brought about through films placed on the tray 12 and the top sheet 14 that are in contact. For example, the tray 12 is made of formable material, such as a multi-layer polymeric lamination, and is usually about 5 mils in thickness to provide some rigidity, allowing the tray 12 to remain in the formed configuration shown in FIGS. 1 and 2. The top sheet 14 is usually about 1-3 mils in thickness and is a polymeric film or a multi-layer polymeric lamination The top sheet 14 includes a layer that, when contacted with the material of the tray 12 under pressure (or heat and pressure), causes the seals 42 and 46 to withstand an opening force of about 2-3 lbs.

Alternatively, the hermetic seal 42 on the three sides of the flange 18 is made of a stronger seal (e.g., about 5-6 lbs. of opening force required) and the top seal 46 is a weaker seal so that the removable section 40 can be readily peeled from the package 10.

Figure 3A:
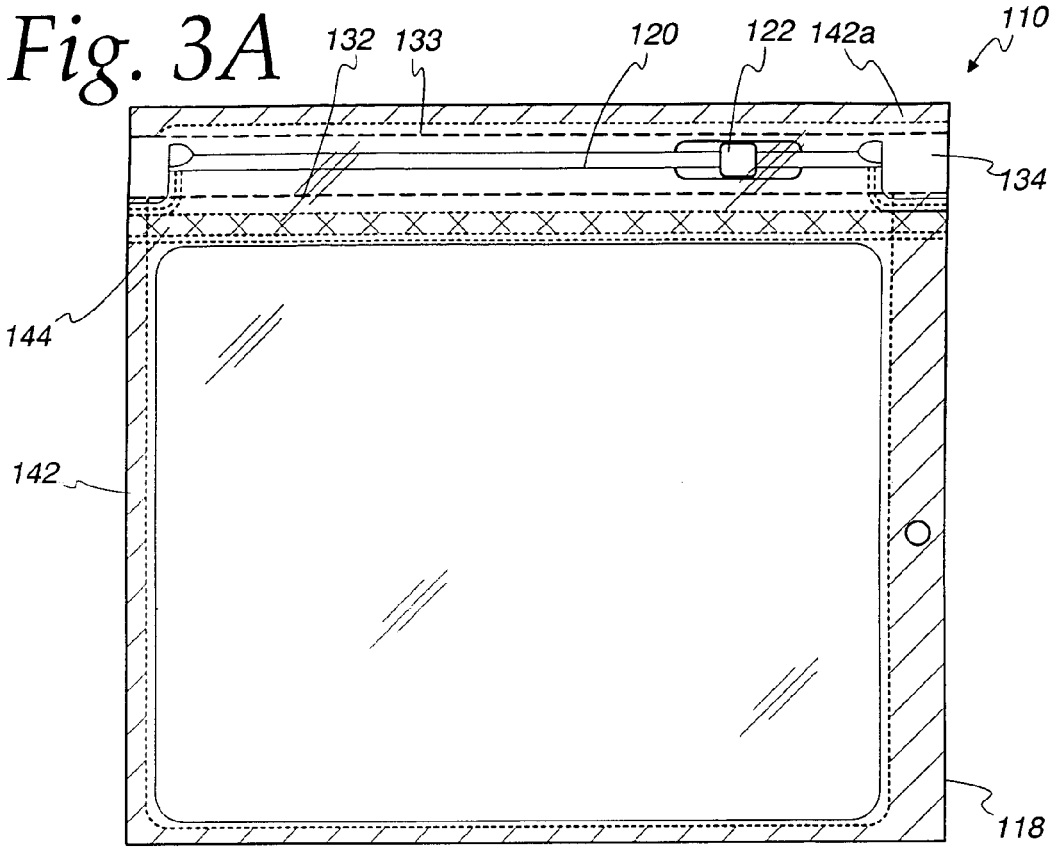
FIGS. 3A and 3B illustrate a package according to an alternative embodiment of the present invention shown in FIGS. 1 and 2.
Figure 3B:
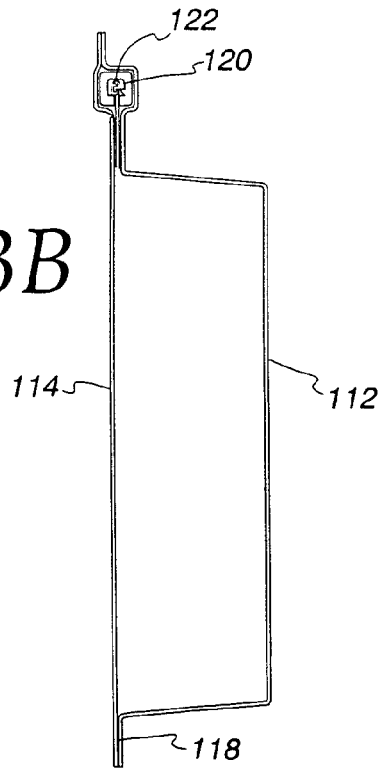

FIGS. 3A and 3B illustrate an alternative package 110 with a tamper-evident feature that has most of the same features as the package 10 of FIGS. 1 and 2, except that all of the reference numerals are now 100-series reference numerals. The package 110 includes a tray 112 and a top sheet 114 that is sealed to a peripheral flange 118 of the tray 112. A fastener 120 resides between the top sheet 114 and the tray 112 at the top portion of the peripheral flange 118.

To seal the contents of the package 110, the top sheet 114 and the tray 112 are sealed with a relatively strong seal 142 along the peripheral flange 118. Additionally, this process 200 involves sealing the top sheet 114 to the flange 118 along a top seal 142*a* above the fastener 120. The fastener 120 has a hermetic seal 144, which is brought about by the attachment of a fin structure located below the interlocking members, as described with respect to FIGS. 1 and 2.

To initially gain access to the package 110, the consumer grasps a graspable section 134, which is located between a first line of weakness 132 and a second line of weakness 133. When doing so, a removable section 140 (FIG. 4) can be torn from the package 110 along these lines of weakness 132, 133, thereby providing a tamperevident feature. As with the embodiment of FIG. 1, the line of weakness 132 is located at a region whereby removal of the removable section 140 provides easy access to the slider 122 and, more preferably, to the entire fastener 120. Thus, the primary difference between the package 110 and the package 10 of FIGS. 1 and 2 is that the package 110 has a second line of weakness 133 and a stronger seal 142*a* at the top part of the peripheral flange 118 that causes a portion of the top sheet 114 to remain attached to the peripheral flange 118 after the removable section 140 is torn from the package 110.

Figure 4:
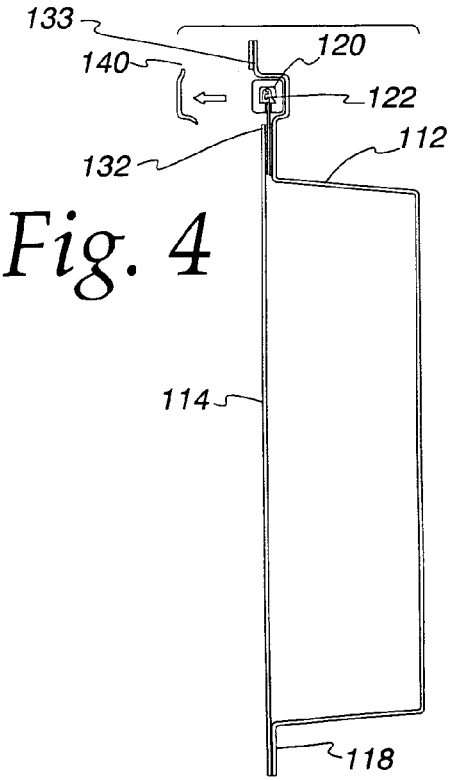
FIG. 4 illustrates the package of FIG. 3 after a removable section of the top cover has been removed to provide access to the fastener.

It should be noted that in the embodiment of FIGS. 3 and 4, the strength of the seals 142, 142*a* can be made enhanced (e.g., 5 to 6 lbs.) everywhere since the second breakable line of weakness 133 removes the need for peeling the tamper-evident removable section 140 from the package 110.

Figure 5:
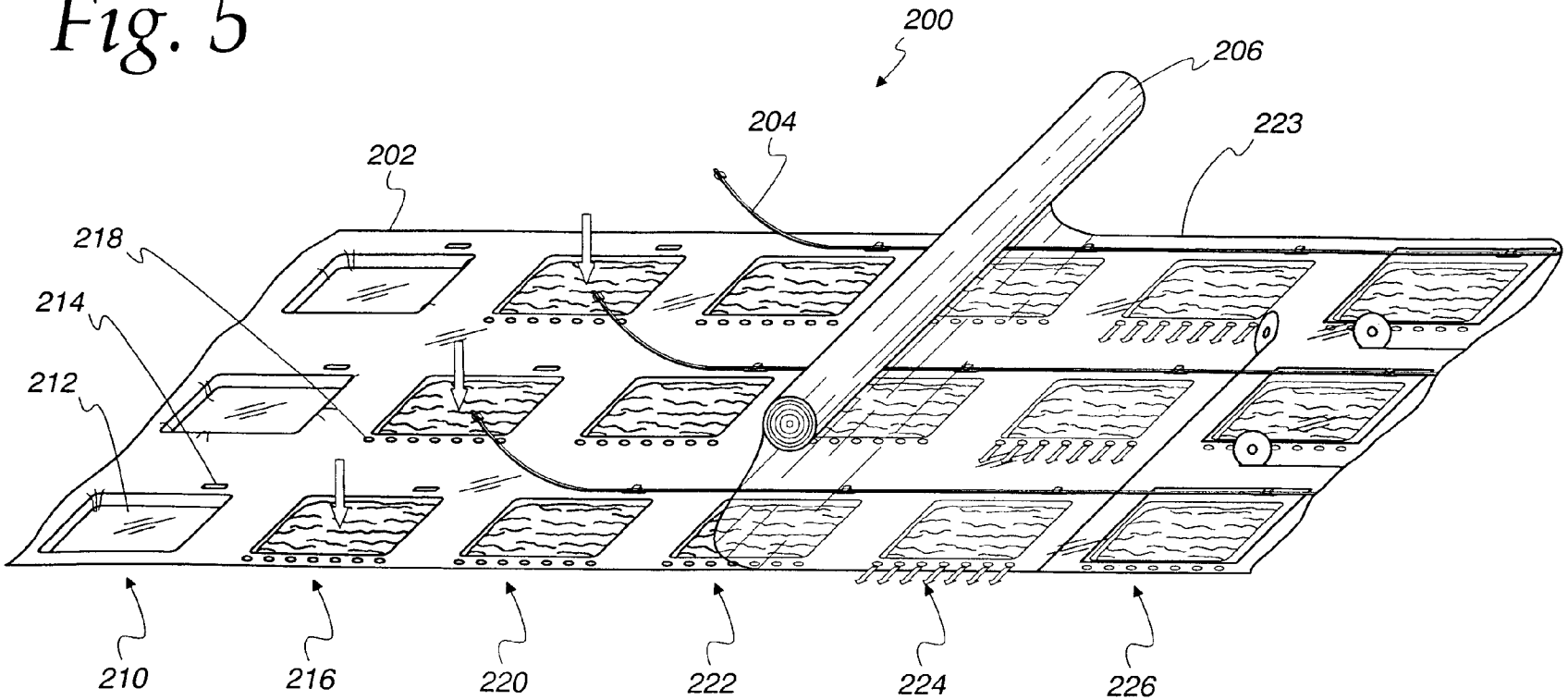
FIG. 5 illustrates the steps in a process that can be used to fabricate the package according to the present invention.
Figure 8:
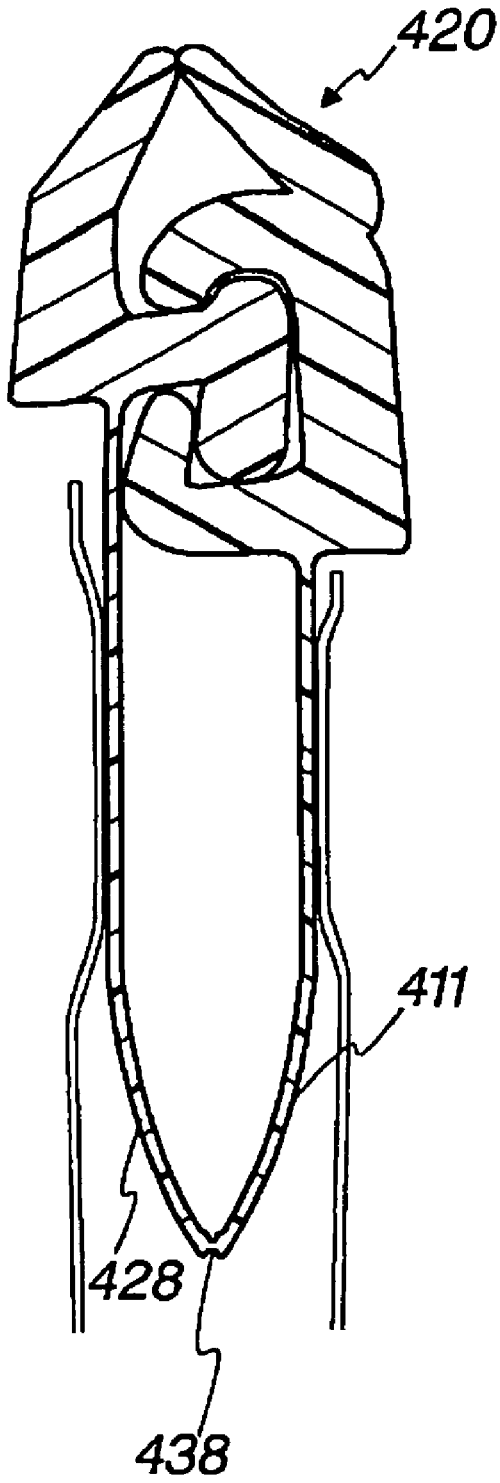
FIG 8 is an illustration of a fastener 420 having fins 428, 411 connected by a line of weakness 438.

FIG. 5 illustrates a process 200 by which the package 10 or the package 110 can be made. The process 200 includes formable material 202, a continuous length of fastener 204, and a roll of material 206 for the top cover sheet. As shown, the process 200 involves a chain of packages that are placed in multiple lanes (three lanes shown), as shown in U.S. Pat. No. 4,949,527, which is incorporated herein by reference in its entirety. In the first step, generally denoted as step 210, the formable material 202 is formed to create a series of wells 212 and slider recesses 214.

In the second step, generally denoted as step 216, the contents for the packages are placed into the wells 212. Additionally, vacuum holes 218 are placed in the formable material adjacent to the wells 212 of the packages. Also, these vacuum holes 218 can be placed in the formable material in a step prior to placement of the contents of the packages into the wells 212.

In the third step 220, a continuous length of fastener 204 is partially attached to the formable material 202. In doing so, a slider located on the fastener 204 is registered such that it falls within the slider recesses 214 located in the formable material 202. The attachment of the continuous length of fastener 204 to the formable material 202 can be accomplished through tacking via adhesive, or by a permanent bond between a fin structure located on the fastener 204 and the formable material 202. The continuous length of fastener 204 can be supplied (and attached to the formable material 202) in the manner that is generally disclosed in U.S. patent application Ser. No. 09/636,421, which is owned by the assignee of the present application and is incorporated herein by reference in its entirety. Such a length of fastener 204 has a slider pre-applied, end stops pre-applied, and sealed sections adjacent the end stops at the point where the fastener 204 is attached to the two sides of the peripheral flange.

In the fourth step, generally denoted as step 222, the roll of material 206 is unwound and placed over the formable material 202 to create a cover sheet 223. The roll of material 206 has the structures (e.g., perforations) which result in the line of weakness 32 (FIGS. 1 and 2) or lines of weakness 132, 133 (FIGS. 3 and 4). Additionally, the roll of material 206 contains the layers of material needed to form the hermetic seal 42 and the peelable seal 46 (FIGS. 1 and 2), or the seals 142, 142*a* (FIGS. 3 and 4).

In the fifth step, generally denoted as step 224, the cover sheet 223 is sealed along that portion of the formable material 200 that is adjacent to each of the wells 212. This seal, as described above, is a strong seal which is capable of withstanding the forces of carrying the contents in each individual package. Usually, at this step, the fastener 204 is permanently sealed to both the top cover 223 and the formable material 202. Also during this step, the air located in the region defined by the cover sheet 223, the formable material 202, and the contents within the wells 212 is evacuated through the vacuum holes 218. As mentioned previously with respect to FIG. 1, because the sliders are located within the slider recesses 214 at a point where the interlocking members of the fastener 200 are not fully closed, the evacuation process causes any air trapped within the fastener 200 to be evacuated, as well.

Finally, in the sixth step, generally denoted as step 226, each of the packages is cut from the formable material 202. These individual packages, which are the packages 10, 110 discussed in FIGS. 1-4, are then arranged in a configuration for inventory or delivery purposes.

FIGS. 6A and 6B illustrate an alternative package 310 that differs from the previous embodiments by having the tamper-evident feature comprised of a portion of both the tray 312 and the top sheet 314. As in the previous embodiments, the top sheet 314 is attached to a peripheral flange 318 of the tray 312. A fastener 320 is located between and attached to the tray 312 and the top sheet 314. The fastener 320 preferably includes a slider 322 for transitioning the interlocking members of the fastener 320 between an open position and a closed position.

The top sheet 314 and the peripheral flange 318 of the tray 312 include, respectively, a first line of weakness 333*a* and a second line of weakness 333*b*. The lines of weakness 333 are at substantially the same height on the package 310 such that they are adjacent to each other. While the lines of weakness 333 are shown as being above the fastener 320 and the slider 322, they could also be below the slider 322, or even below the interlocking members of the fastener 320. The top sheet 314 and the peripheral flange 318 have unattached regions 335*a* and 335*b* below the lines of weakness 333. As in the previous embodiments, the top sheet 314 is attached to the peripheral flange 318 on the bottom and two sides of the peripheral flange by a hermetic seal 342. Additionally, the top sheet 314 is attached to the top portion of the flange 318 with a second seal 342*a*. Accordingly, the first hermetic seal 342 is spaced away from the second seal 342*a* by the dimension of the unattached regions 335. The fastener 320 also includes a hermetic seal 344 that extends between the two sides of the peripheral flange 318 to maintain the integrity of the contents located within the tray 312. This hermetic seal 344 is breakable by the consumer when the consumer accesses the contents the first time.

As shown in FIG. 7, to gain access to the fastener 320 and the slider 322, the tamper-evident removable section 340 is pulled from the top of the package 310. Because the tray 312 is made of a material that is substantially more rigid than the top sheet 314, the fastener 320 and the slider 322 remain adjacent to the top of the peripheral flange 318. The top sheet 314, however, has a foldable section 345 above an attachment line 346 where the fin of the fastener 320 is attached to the top sheet 314. This foldable section 345, located below the first line of weakness 333*a*, is easily folded downwardly by the consumer to gain access to the fastener 320 and the slider 322. Unlike prior art systems, the entire length of the foldable section 345 can be rotated downwardly due to the unattached regions 335 located at the side edges of the peripheral flange 318 between the hermetic seal 342 and the second seal 342*a* (i.e., adjacent to the ends of the fastener 320). In essence, the attachment line 346 is a hinge around which the foldable section 345 is rotated.

The package 310 can be made in generally the same manner described with respect to FIG. 5. The primary difference is that the flange 318 must include structures providing the breakable line of weakness 333*b*. This can be accomplished by having the formable material having the wells include this line-of-weakness structure before attaching the fastener to the formable material. Or, the lines of weakness 333*a* and 333*b* can be formed simultaneously by a device (e.g., a laser) after the top sheet is located on the formable material.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable package, comprising:

a tray having a well and a peripheral flange, said well receiving contents and said peripheral flange surrounding a perimeter of said well;

a top sheet attached to said peripheral flange with a generally continuous first seal extending around less than the perimeter of said well; said top sheet attached to an upper portion of said peripheral flange with a second seal separated from the first seal;

a fastener having first and second interlocking members, said first interlocking member being attached to said peripheral flange, and said second interlocking member being attached to said top sheet along an attachment region;

a recess defined in the flange of the tray, the recess configured to receive a slider;

a tamper-evident feature attached to said top sheet along a first line of weakness and attached to said peripheral flange of said tray along a second line of weakness, said tamper-evident feature being removable from said package to allow access to said fastener; and wherein, in response to said tamper-evident feature being removed from said package, said fastener remains directly adjacent to said peripheral flange of said tray, and an entire length of said top sheet located below said first line of weakness and above said attachment region is foldable away from both said first and said second interlocking members of said fastener, while said first and said second interlocking members remain interlocked.

2. The reclosable package of claim 1, wherein said slider operates to transition said fastener between an open position and a closed position, said slider resides in said recess when said fastener is moved toward said closed position.

3. The reclosable package of claim 2, wherein said first and second lines of weakness are located above said slider.

4. The reclosable package of claim 1, wherein said first and second lines of weakness are at substantially the same heights on said package.

5. The reclosable package of claim 1, wherein said tray is substantially more rigid than said top sheet.

6. The reclosable package of claim 1, wherein said peripheral flange includes a bottom, two sides, and said top, said fastener being located adjacent said top, one of said two sides including a peg hole for receiving a peg that allows the package to be displayed in a retail store.

7. The reclosable package of claim 1, wherein said fastener includes a hermetic seal adjacent to said first and second interlocking members, said hermetic seal being broken after said tamper-evident feature is removed from said package.

8. A reclosable package, comprising:

a tray having a well and a peripheral flange, said well receiving contents and said peripheral flange surrounding a perimeter of said well, said peripheral flange having a top, two sides and a bottom;

a top sheet attached to said bottom and at least a portion of each of said sides of said peripheral flange with a generally continuous first seal extending around less than the perimeter of said well, said top sheet further being attached to said top of said peripheral flange with a generally continuous second seal, said first seal being spaced away from said second seal;

a fastener having first and second interlocking members, said first interlocking member being attached to said peripheral flange and said second interlocking member being attached to said top sheet; and a tamper-evident feature attached to said top sheet along a first line of weakness and attached to one of said top sheet and said peripheral flange of the tray along a second line of weakness, said first and second lines of weakness being above said first seal, said tamper-evident feature being removable from said package along said lines of weakness to allow access to said fastener.

9. The reclosable package of claim 8, wherein said fastener includes a hermetic seal adjacent to said first and second interlocking members, said hermetic seal being breakable by a consumer after said tamper-evident feature is removed from said package.

10. The reclosable package of claim 9, wherein said hermetic seal is located below said first and second interlocking members.

11. The reclosable package of claim 8, further including a hermetic seal extending generally parallel to said interlocking members between said two sides of said peripheral flange.

12. The reclosable package of claim 8, further including a slider attached to said fastener for transitioning said fastener between an open position and a closed position.

13. The reclosable package of claim 12, wherein said lines of weakness are above said slider, edge sections of said top sheet adjacent to said two sides of said peripheral flange being unattached to said peripheral flange allowing an entire length of said top sheet between said two sides of said peripheral flange to be folded away from said peripheral flange.

14. The reclosable package of claim 12, wherein said lines of weakness are below said slider.

15. The reclosable package of claim 8, wherein said lines of weakness are below said second seal.

16. The reclosable package of claim 8, wherein one of said two sides of said peripheral flange includes a peg hole for receiving a peg to display said package in a retail setting.

17. The reclosable package of claim 8, wherein said lines of weakness are adjacent to each other.

18. A reclosable package, comprising:

a tray having a well and a peripheral flange, said well receiving contents and said peripheral flange surrounding a perimeter of said well, said peripheral flange having a top, two sides and a bottom;

a top sheet attached to said bottom and at least a portion of each of said sides of said peripheral flange with a generally continuous first seal extending around less than the perimeter of said well, said top sheet further being attached to said top of said peripheral flange with a generally continuous second seal, said first seal being spaced from said second seal;

a fastener having first and second interlocking members, said first interlocking member being attached to said peripheral flange and said second interlocking member being attached to said top sheet, said fastener having a first end and a second end; and a tamper-evident feature attached to said top sheet along a first line of weakness and said peripheral flange of said tray along a second line of weakness, said tamper-evident feature being removable from said package along said lines of weakness to allow access to said fastener, said lines of weakness being above said fastener, edges of said peripheral flange of said tray and said top sheet that are adjacent to said first and second ends of said fastener being unattached so that said fastener is accessible between said peripheral flange of said tray and said top sheet after said tamper-evident feature is removed.

19. The redo sable package of claim 18, wherein each of said first and said second ends of said fastener include an unattached region, said first and second interlocking members being located between said unattached regions.

20. The reclosable package of claim 18, wherein said fastener includes a hermetic seal adjacent to said first and second interlocking members, said hermetic seal being breakable by a consumer after said tamper-evident feature is removed from said package.

21. The reclosable package of claim 20, wherein said hermetic seal is located below said first and second interlocking members.

22. The reclosable package of clam 18, further including a slider attached to said fastener for transitioning said fastener between an open position and a closed position.

23. The reclosable package of claim 22, wherein said lines of weakness are above said slider.

24. The reclosable package of claim 22, wherein said lines of weakness are below said slider.

25. A reclosable package, comprising:

a tray having a well and a peripheral flange, said well receiving contents and said peripheral flange surrounding a perimeter of said well, said peripheral flange having a top, two sides and a bottom;

a top sheet attached to said bottom and at least a portion of each of said sides of said peripheral flange with a generally continuous first seal extending around less than the perimeter of the well, said top sheet further being attached to said top of said peripheral flange with a generally continuous second seal, said first seal being spaced away from said second seal, said top sheet having edge sections, said edge sections being adjacent to said two sides of said peripheral flange and being unattached to said peripheral flange allowing an entire length of said top sheet between said two sides of said peripheral flange to be folded away from said peripheral flange;

a fastener having first and second interlocking members, said first interlocking member being attached to said peripheral flange and said second interlocking member being attached to said top sheet;

a slider attached to said fastener for transitioning said fastener between an open position and a closed position; and a tamper evident feature attached to said top sheet along a first line of weakness and attached to said peripheral flange of the tray along a second line of weakness, said first and second lines of weakness being above said first seal and above said slider, said tamper-evident feature being removable from said package along said lines of weakness to allow access to said fastener.

26. A reclosable package comprising:

a tray having a well and a peripheral flange, said well receiving contents and said peripheral flange surrounding a perimeter of said well, said peripheral flange having a top, two sides and a bottom;

a top sheet attached to said bottom and at least a portion of each of said sides of said peripheral flange with a generally continuous first seal extending around less than the perimeter of said well, said top sheet further being attached to said top of said peripheral flange with a generally continuous second seal, said first seal being spaced away from said second seal;

a fastener having first and second interlocking members, said first interlocking member being attached to said peripheral flange and said second interlocking member being attached to said top sheet;

a slider attached to said fastener for transitioning said fastener between an open position and a closed position; and a tamper evident feature attached to said top sheet along a first line of weakness and attached to said peripheral flange of the tray along a second line of weakness, said first and second lines of weakness being above said first seal and below said slider, said tamper-evident feature being removable from said package along said lines of weakness to allow access to said fastener.

* * * * *

UNITED STATES PATENT AND TRADEMARK OFFICE

CERTIFICATE OF CORRECTION

PATENT NO. : 7,341,160 B2
APPLICATION NO. : 10/215052
DATED : March 11, 2008
INVENTOR(S) : Craig E. Cappel et al.

It is certified that error appears in the above-identified patent and that said Letters Patent is hereby corrected as shown below:

Column 8, line 64 should read:

--reclosable-- instead of

"redo sable"

Column 10, insert the following claim 27 after (claim 26) line 37:

--27. The reclosable package of claim 1, wherein said first seal is located within said tamper-evident feature and is removed with said tamper-evident feature.--

Signed and Sealed this

Fifteenth Day of September, 2009

David J. Kappos

David J. Kappos
*Director of the United States Patent and Trademark Office*